United States Patent [19]

deLarosiere

[11] 4,416,373

[45] Nov. 22, 1983

[54] INTERLOCKING STACKABLE BOTTLES

[76] Inventor: Pierre J. deLarosiere, 30 Rua D. Palmela, Lisbon, Portugal

[21] Appl. No.: 345,684

[22] Filed: Feb. 4, 1982

[51] Int. Cl.[3] ..... B65D 65/00; B65D 85/62; B65D 21/02

[52] U.S. Cl. ..... 206/432; 206/504; 206/509; 206/503; 215/1 C; 220/23.4

[58] Field of Search ..... 206/203, 432, 509, 503, 206/459, 427, 504; 220/23.4; 215/1 C

[56] References Cited

U.S. PATENT DOCUMENTS

| | | | |
|---|---|---|---|
| 3,927,782 | 12/1975 | Edwards | 215/1 C |
| 4,155,479 | 5/1979 | Liechti et al. | 220/23.4 |
| 4,344,530 | 8/1982 | deLarosiere | 206/203 |

FOREIGN PATENT DOCUMENTS

| | | | |
|---|---|---|---|
| 2235839 | 1/1975 | France | 206/509 |
| 2051723 | 1/1981 | United Kingdom | 206/432 |

*Primary Examiner*—William T. Dixson, Jr.
*Assistant Examiner*—Brenda J. Ehrhardt
*Attorney, Agent, or Firm*—Pennie & Edmonds

[57] ABSTRACT

A plastic bottle 4 for beverage or other liquid has a liquid container 6, a top closure 10, and a base cup 8. The base cup 8 includes an interlock band 12 surrounding it to permit two bottles to interlock. The base cup also includes a bottle stacking support 30 to permit a first bottle 4 to rest upon the top closure 10 of a second bottle 4. A rectangular array of such bottles can be surrounded laterally by a binding such as a sheath of plastic shrink-wrap film 5 to form a readily transportable bundle 2. The bundles 2 can be stacked in multi-tiered structures for warehousing.

4 Claims, 7 Drawing Figures

FIG. 1
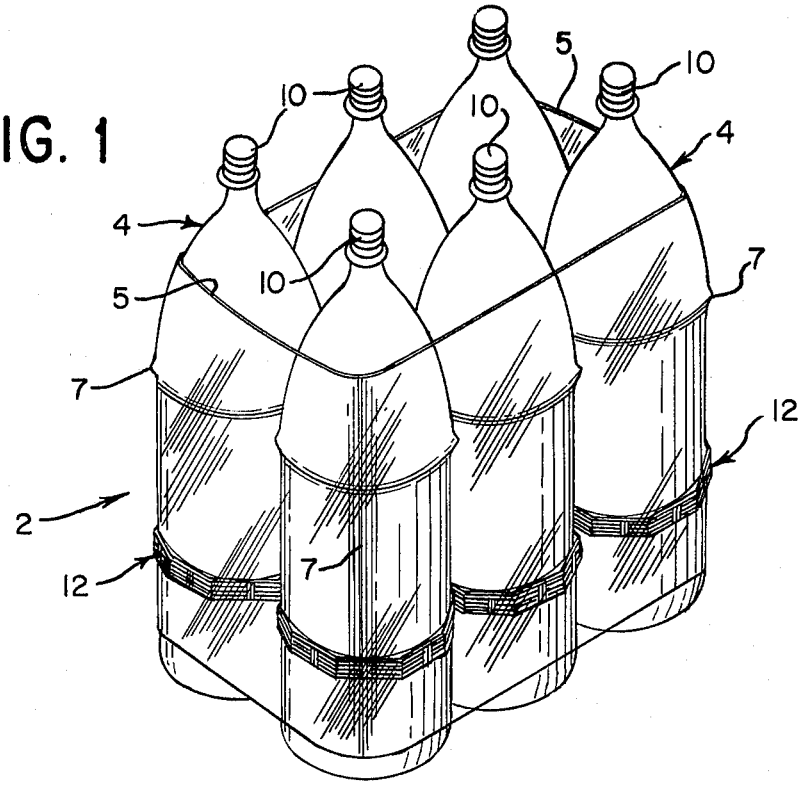
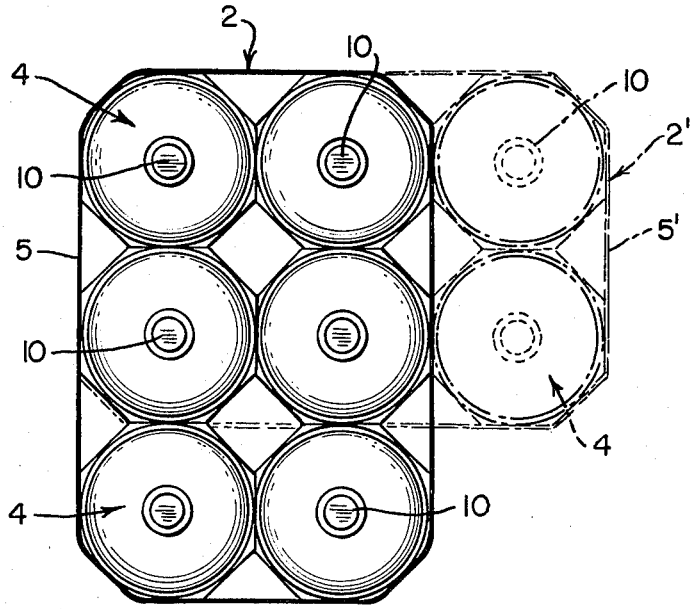
FIG. 3

INTERLOCKING STACKABLE BOTTLES

DESCRIPTION

1. Technical Field

The present invention relates to plastic bottles for beverages and other liquids.

2. Background Art

Bottles made of plastic are widely used as containers for retailing soft drinks and other liquids. Two-piece plastic bottles having a liquid container made of polyethylene terephthalate (PET) and a base cup, typically made of polyethylene, have become particularly popular with the soft-drink industry because of their transparency, light weight and low cost. Although the walls of the liquid containers of such two-piece bottles are flexible, they are strong in tension and thus can safely contain the pressure of a carbonated beverage. Moreover, conventional two-piece plastic PET bottles can bear surprisingly high compressive loads, provided that the load is directed substantially along an axial symmetry axis of the bottle. Thus a single two-piece plastic bottle axially symmetric in shape and having a bottle closure sealing the opening of the bottle can support the weight of many bottles of the same size filled with beverage if the bottle in question is standing upright on a flat, horizontal surface and the weight of the other bottles is applied to the closure of the single bottle and directed substantially vertically along the symmetry axis. However, if a compressive load is applied to a conventional two-piece plastic bottle along a direction other than the symmetry axis of the bottle, the bottle tends to buckle and give way. The tendency of conventional two-piece plastic bottles to give way under off-axis compressive loads is particularly pronounced for large capacity bottles, such as a two-liter bottle widely used for marketing soft drinks.

Bottles of soft drinks are ordinarily packaged by bottlers in cases or other containers, several bottles to the case, for shipment to retailers or for storage. Cases of bottles are customarily stacked one on top of the other for warehousing and shipment. Because of the tendency of conventional two-piece plastic bottles to buckle under off-axis loads, attempts to stack cases of these bottles give rise to serious problems for which no completely satisfactory solution has heretofore been available. For example, bottles can become tilted away from vertical alignment upon stacking if conventional partitioned cases having low side walls are used to contain the bottles. Tilted bottles in the lower cases of such a stack can buckle and give way, causing the stack to fall. Even should the bottles not buckle, the tendency of bottles, particularly tall, large-capacity bottles, to become tilted in conventional low-sided cases can give rise to problems. Such tilting generally places an undesirably low limit on the number of tiers in a stack since the tilting of bottles away from vertical in one case can cause the next higher case in the stack to become tilted away from horizontal, which can lead to instability if too many tiers are included in the stack.

One method of dealing with these problems in the past involved packaging bottles of beverage in corrugated-paper cartons having high sides, equal in height to the height of the bottles, for example. Thus, two-liter plastic bottles filled with soft drinks are often packaged in enclosed corrugated paper cartons for warehousing and shipment. Although the high sides of such cartons reduce the incidence of tilting and provide additional support when the cartons are stacked, the cartons represent a significant expense. The expense of the cartons cannot ordinarily be distributed over a number of repeated uses since corrugated paper cartons are not generally rugged enough for reuse and are therefore usually discarded by the retailer. Moreover, corrugated paper cartons can be relatively easily deformed, particularly in humid climates, which permits bottles contained in the cartons to become tilted. Consequently, bottlers have had to limit the height of stacks of cartons of bottles with the result that greater warehouse floor space is required to store the bottles than would be required if higher stacks were more stable.

A second method used in the past for dealing with the problems of storing and transporting two-piece plastic bottles of beverage involved placing the bottles in a corrugated paper tray and, to keep the bottles in place, wrapping a sheath of plastic shrink-wrap film around the bottles and the tray. The plastic film generally stretched over the tops of the bottles and under the tray. The combination of a corrugated-paper tray and a plastic shrink-wrap film is comparable in expense to an enclosed corrugated-paper carton. This method therefore shares the disadvantage of high expense with the method of packing bottles in enclosed corrugated-paper cartons. Furthermore, since the corrugated paper trays have relatively low sides, the bottles have a greater tendency to tilt than in the case of an enclosed corrugated-paper carton. Consequently, corrugated-paper trays loaded with bottles and wrapped with shrink-wrap film generally form even less stable stacks than enclosed corrugated-paper cartons of bottles. The corrugated-paper tray can be used to display the bottles in a retail store. However, the shrink wrap film must be removed from the bottles and the tray by the retailer to permit access to the bottles. However, the film is a nuisance to remove from under the tray without upsetting the bottles, which tends to slow down the stocking of the trays of bottles by the retailer.

A third method used in the past for storing and transporting two-piece plastic bottles involves loading the bottles in tightly-fitting plastic crates. Such crates can obviate the need for a plastic-film overwrap to hold the bottles in place, as generally required with the corrugated-paper trays discussed above. See U.S. patent application Ser. No., 188,252 filed Sept. 17, 1980, now U.S. Pat. No. 4,344,530, of the present applicant. While such crates can provide a satisfactory means for storage and transport of two-piece plastic bottles in many bottling operations, they nonetheless represent a substantial capital investment and are subject to theft and breakage. Moreover, such crates are generally not disposable, but must be returned from the retailer to the bottler, which entails additional handling and transportation expenses.

DISCLOSURE OF THE INVENTION

I have invented a stackable, interlocking bottle, groups of which can be bound into bundles for storing and transporting the bottles without the need for cartons, crates or trays, avoiding problems of the prior art noted above.

Broadly, the bottle of the invention comprises a liquid container, a top closure for the liquid container, and a base cup having an interlock band surrounding it for interlocking groups of bottles.

The liquid container of the bottle of the invention is made of a plastic material, such as polyethylene terephthalate. The liquid container is generally symmetric in shape about a centerline. The container has a container opening in it for filling and discharging liquid. The container opening is located so that the centerline passes centrally through the opening. The bottle comprises a top closure for sealing the container opening.

The bottle of the invention also comprises a base cup joined to a base end of the liquid container. The base cup is made of a plastic material such as high density polyethylene. The base cup is shaped to permit the bottle to stand upright on a horizontal surface with the centerline of the container extending in a substantially vertical direction. For convenience, a bottle-rest reference plan is defined to be a plane which is tangent to the points of the base cup on which the base cup rests when the bottle is standing upright on a horizontal surface.

The base cup of the bottle of the invention includes a base-cup interlock band joined to the base cup. The interlock band extends generally parallel to the bottle-rest reference plane around an outer surface of the base cup. The interlock band includes a plurality of interlock band segments. Each interlock band segment corresponds to the side of a reference equilateral polygon defined to by lying in the reference plane and centered with respect to the centerline of the liquid container. The number of interlock band segments equals a multiple of four greater than or equal to eight. Thus, for example, 8, 12 or 16 interlock band segments may be used. A segment intersection is defined between each pair of adjacent interlock band segments. An outwardly-facing surface of each interlock band segment defines an interlock facet. Each interlock facet extends in a direction generally parallel to the corresponding side of the reference polygon and also extends in a direction generally parallel to the centerline. The interlock facets are preferably rectangular in shape. The segment intersections are generally rounded. Each interlock facet has a contoured surface adapted to interlock with a second interlock facet urged against it.

Preferably, the surface contour of the facets takes the form of horizontal and vertical grooves. In this case, each interlock fact has a plurality of grooves passing through it which extend generally parallel to the centerline to define vertical facet grooves. In addition, each pair of adjacent facets have a plurality of grooves which extend generally parallel to the reference plane to define horizontal facet grooves. The horizontal facet grooves extend between a first vertical facet groove located on a first facet of a pair of adjacent facets and closest to a second facet of the pair and a second vertical facet groove located on the second facet and closest to the first facet. The width of the horizontal grooves is greater than the spacing between adjacent grooves and the spacing between boundaries of the facet and horizontal facet grooves adjacent to the boundaries. Similarly, the width of the vertical facet grooves is greater than the spacing between adjacent vertical facet grooves. Consequently, the horizontal and vertical facet grooves of a facet of one bottle can mesh with the horizontal and vertical facet grooves of a facet of another bottle to interlock the bottles and so prevent the bottles from moving relative to one another.

The base cup of the bottle of the invention also includes a bottle stacking support connected to the base cup and abuting a base portion of the liquid container. The bottle stacking support is centered relative to the centerline of the liquid container and is spaced apart from the bottle-rest reference plane. The base cup is shaped to define a closure guide which opens from the bottle stacking support to the bottle-rest reference plane. The closure guide is shaped to receive the top of a closure of a second bottle inserted in the closure guide and to guide the closure top to the bottle stacking support. The bottle stacking support is adapted to transmit the weight of a first bottle to the top of the closure of a second bottle upon which the first bottle rests.

The base cup of the bottle of the invention preferably includes a plurality of support ribs extending between a base portion of the liquid container to the base-rest reference plane. When the bottles of the invention are bound together into bundles and the bundles of bottles are stacked in a multitiered structure, the weight of the entire stack must be transmitted to the surface on which the stack rests through the base cups of the bottles in the lower-most tier of bundles. The support ribs are sufficiently strong to transmit the fraction of the weight of the stack borne by a bottle in the lower-most tier from the liquid container of the bottle to the surface on which the bottle rests.

Groups of bottles of the invention can be bound together into bundles by arranging the bottles facet to facet in a rectangular array and wrapping the group of bottles laterally with a binding such as a sheath of plastic shrink-wrap film. Preferably six bottles are grouped in a bundle, although other numbers of bottles can be ued if desired. A handle can be connected to the necks of two or more bottles for carrying the bundle if desired. The bottles within a bundle cannot rotate because of the shape of the facets. The bottles cannot slide horizontally with respect to one another because of the interlocking of the facets and the tension applied by the binding. The bottles also cannot slip vertically with respect to one another because of the interlocking of the facets. Consequently, bundles of bottles of the present invention are extremely stable and can be stored and transported without additional packaging. The bundles can be readily formed by mechanical equipment suitable for use on a bottling line.

Since the binding need not pass under the bottles, the binding of the bundles can be readily removed on the shelf by the retailer, which facilitates stocking the bottles.

The bundles of bottles of the present invention are generally less expensive than prior art corrugated-paper containers of conventional two-piece plastic bottles of the same capacity. The cost of manufacturing a bottle of the present invention is only slightly higher than the cost of manufacturing a conventional two-piece plastic bottle, since the interlock band of the base cup of the invention requires little additional plastic for molding. Use of expensive returnable cartons or crates is not required with the bottles of the present invention. Consequently, the present invention represents an extremely economical way to store and transport two-piece plastic bottles of beverage or other liquids.

BRIEF DESCRIPTION OF THE DRAWINGS

Preferred embodiments of the invention are described below with reference to the following drawings:

FIG. 1 is a perspective view of a bundle of six preferred bottles of the present invention.

FIG. 3 is a top view of a first and a second bundle of preferred bottles of the invention, with the first bundle resting on top of the second bundle and oriented at right angles to the second bundle as the two bundles would be oriented in a cross-stacked structure. The second bundle is shown in phantom.

BEST MODE FOR CARRYING OUT THE INVENTION

Figure 2:
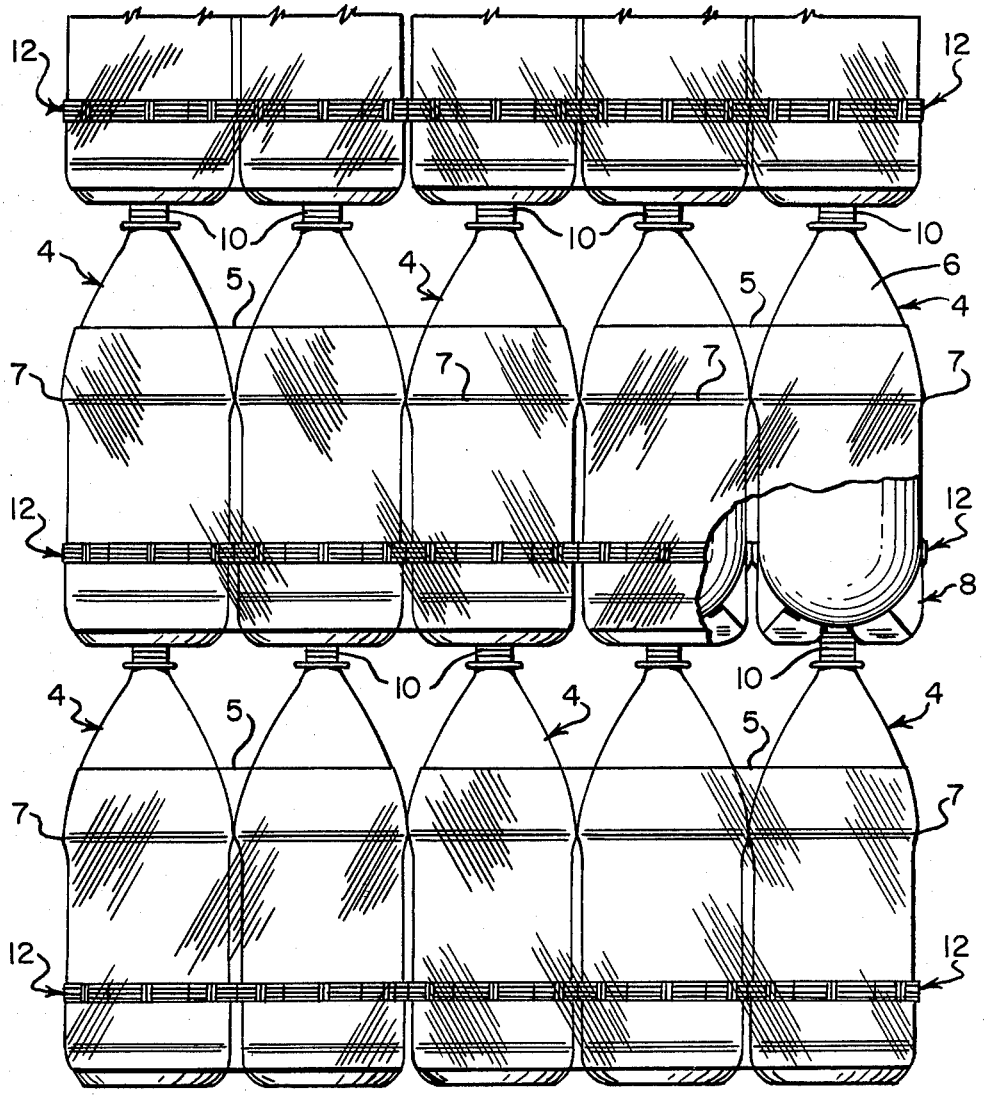
FIG. 2 is a partial cutaway side view of a cross-stacked structure made up of bundles of preferred bottles of the invention as shown in FIG. 1.

Turning now to FIG. 1, a bundle 2 of preferred bottles of the invention includes a group of six bottles 4 arranged in a rectangular array and surrounded laterally by a sheath of shrink-wrap plastic 5. As shown best in FIG. 2, each bottle 4 includes a liquid container 6, a base cup 8 and a bottle closure 10. The liquid container 6 is transparent and made of polyethylene terephthalate by conventional molding techniques. The liquid container 6 has a generally axially-symmetric shape with an outwardly projecting bulge 7 located intermediate between the bottle closure 10 and the base cup 8. The base cup 8 is joined to a hemispherial lower portion of the liquid container 6 and is shaped to permit the bottle 4 to stand upright on a horizontal surface. The base cup 8 is made of high-density polyethylene by conventional molding techniques. An interlock band 12 surrounds the base cup 8.

Figure 4:
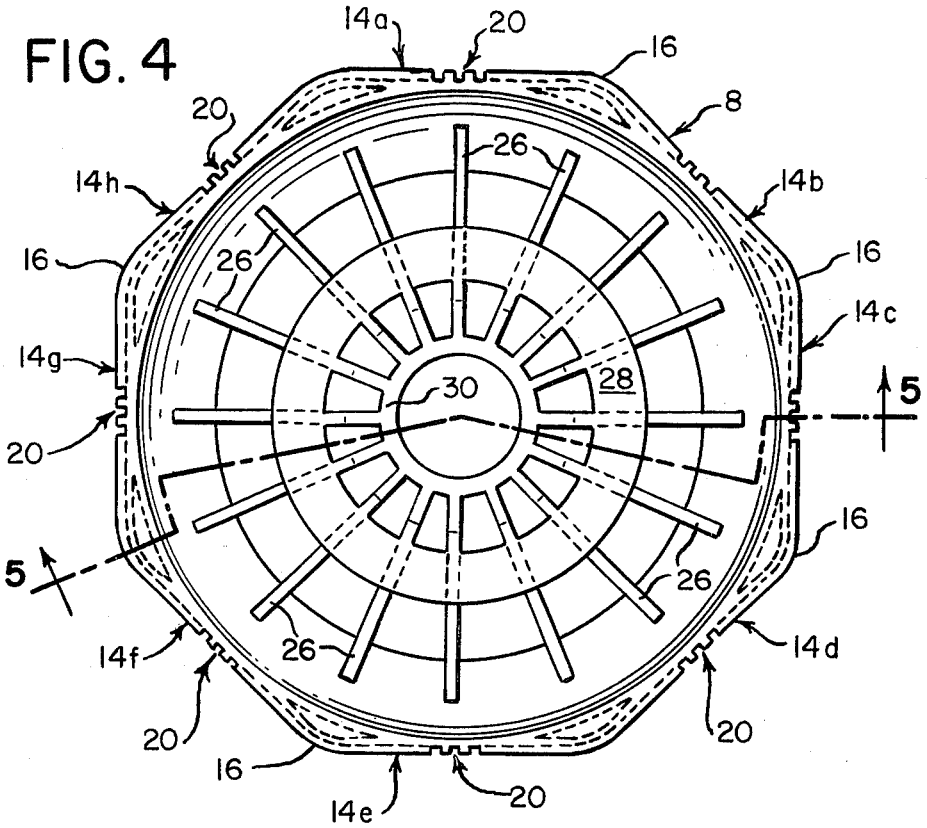
FIG. 4 is a top view of a preferred base cup of the present invention.
Figure 5:
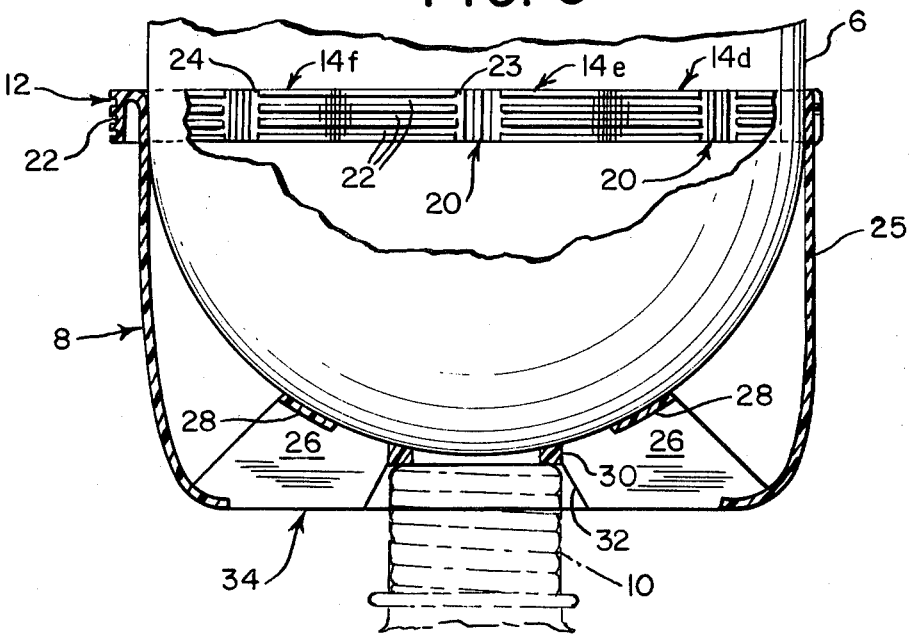
FIG. 5 is a side view in partial section of a base portion of a preferred bottle of the present invention. The base cup is the base cup of FIG. 4 shown in cross section taken along line 5—5 of FIG. 4.

As shown best in FIGS. 4 and 5, the interlock band 12 is made up of eight interlock band segments. An outwardly facing surface of each interlock band segment defines an interlock facet 14. Each interlock facet 14 is generally rectangular, with a first side extending generally parallel to a centerline of the liquid container 6 and an adjacent side extending generally parallel to the side of a reference octagon defined to be centered on the centerline of the liquid container 6 and located in a reference plane defined to be normal to the centerline. The interlock band 12 is substantially horizontal when the bottle 4 is standing upright on a horizontal surface. Intersections 16 between adjacent interlock band segments are rounded.

Figure 6:
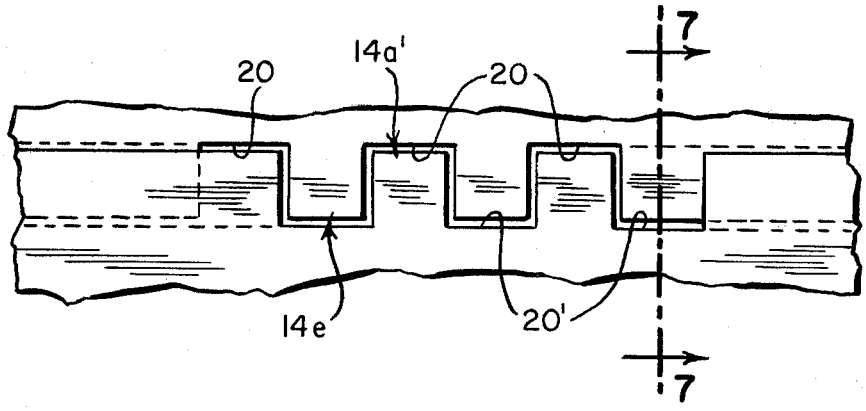
FIG. 6 is partial top view in enlarged scale of two facets of two base cups of the invention in an interlocked configuration.

Three grooves extend through each interlock facet 14 in a direction generally parallel to the centerline of the liquid container 6 to defined three vertical facet grooves 20. As shown best in FIG. 6, the width of each vertical facet groove 20 is slightly greater than the spacing between adjacent grooves so that the vertical facet grooves 20 in a facet 14*e* on a first bottle can mesh with the vertical facet grooves 20′ in a facet 14*a*′ on a second bottle, as described more fully below.

Figure 7:
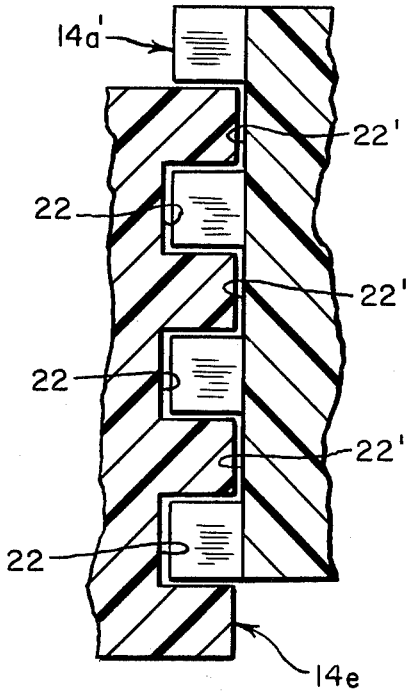
FIG. 7 is a cross-sectional view taken along line 7—7 of FIG. 6.

As shown best in FIG. 5, three grooves extend in a horizontal direction when the bottle 4 is standing upright between each pair of adjacent facets to define three horizontal facet grooves 22. Specifically, the horizontal facet grooves 22 extend between a first vertical facet groove 23 in a first facet 14*e* of the pair of facets and a second vertical facet groove 24 in a second facet 14*f* of the pair, the first vertical facet groove 23 being the vertical facet groove in the first facet which is closest to the second facet and the second vertical facet groove 24 being the vertical facet groove in the second facet 14*f* which is closest to the first facet. As shown best in FIG. 7, the width of the horizontal facet grooves 22 is slightly greater than the spacing between adjacent grooves and the spacing between the horizontal edges of the facets and the horizontal facet grooves adjacent to the horizontal edges so that the horizontal facet grooves 22 of the face 14*e* of a first bottle can mesh with the horizontal facet grooves 22′ of a facet 14*a*′ of a second bottle. When the facet grooves of the facets of two bottles 4 are meshed, the bulges 7 of the liquid containers 6 of the two bottles touch one another.

The base cup 8 has an outer wall 25. An upper portion of the outer wall 24 of the base cup 8 when the bottle 4 is standing upright is fitted against an outer surface of the liquid container 6. A lower portion of the outer wall of the base cup 8 turns under the bottle towards the centerline.

Sixteen support ribs 26 are joined to the lower portion of the outer wall 25 of the base cup 24. The support ribs 26 extend in a radial direction and are disposed substantially equiangularly about the centerline of the liquid container 6. A liquid-container seating ring 28 is located concentrically of the centerline and is connected to the support ribs 26. The seating ring 28 is generally annular in shape and conforms to the outer surface of a base portion of the liquid container 6. The base cup 8 is connected to the liquid container 6 by means of an adhesive which cements the liquid-container seating ring 28 to the liquid container 6.

A bottle-stacking support ring 30 abuts a base portion of the liquid container 6 and is concentric of the centerline of the liquid container 6. An inside diameter of the support ring 30 is less than the outside diameter of the top of a closure 10 of the bottle so that the support ring can rest on the top of a closure. An upper side of the support ring 30 is contoured to conform to the surface of the liquid container 6. The bottle-stacking support ring 30 is connected to the support ribs 26. A bottle-rest reference plane 34 is defined to be a planar surface which is tangent to points of the base cup 8 which contact a horizontal surface when the bottle 4 is standing upright on the surface. The support ring 30 is spaced apart from the bottle-rest reference plane.

Each support rib 26 has a closure-guide edge 32 which extends between the bottle-stacking support ring 30 and the bottle-rest reference plane 34. Each closure-guide edge 32 is inclined with respect to the centerline of the liquid container 6 so that the distance between the closure-guide edge 32 and the centerline is at a minimum at the support ring 30. The closure-guide edges 32 of the support ribs 26 define a closure guide 36 which flares outward as it opens from the support ring 30 to the reference plane 34. The closure guide 36 is shaped to guide the top of a closure 10 inserted into the closure guide to the bottle-stacking support ring 30. As shown best in FIG. 2, bundles of bottles of the invention can be stacked one on top of the other with the bottle-stacking support rings 30 of the bottles in each upper layer resting upon the tops of the closures 10 of the bottles in the next lower layer. The shape of the interlock bands permits the bundles 2 to be cross-stacked, as shown in FIG. 3.

To form the bundle 2 of six bottles 4 of the present invention, the bottles are placed upright on a horizontal surface and brought together in a rectangular array of two rows of three bottles. Moving the bottles together to form the array is ordinarily sufficient to cause a pair of facets 14 on each pair of adjacent bottles in the array to become engaged, with the horizontal grooves 22 and vertical grooves 20 of the pair of facets meshed together. The rounded shape of the segment intersections 16 facilitate the interlocking of pairs of facets 14 since the horizontal grooves at a rounded segment intersection 16 can readily penetrate and engage the horizontal facet grooves of an interlock band which the intersection encounters as the bottles are brought together. Once the grooves of a rounded segment intersection 16 have engaged the horizontal facet grooves of the interlock band of a second bottle, they tend to remain engaged as the two bottles are brought closer together. The segment intersection 16 can pivot and slide as the bottles move together to guide the horizontal grooves of a facet adjacent to the segment intersection into engagement with the horizontal grooves of a facet on the interlock band of the second bottle. Six bottles are then surrounded laterally by a length of tubing of plastic shrink-wrap film in the extended state. The shrink-wrap film 5 is caused to shrink to bind the bundle of bottles together. The operations of forming a bundle of interlocked bottles of the present invention can readily be carried out by machine on a bottling line.

The interlocking of facets of adjacent bottles tends to prevent the bottles in the bundle from sliding relative to one another in a vertical direction or from sliding past one another in a lateral direction. Tension from the shrink-wrap film tends to keep the bottles from pulling apart from another. The contact between adjacent bottles 4 at the facets of the interlock bands 12 and at the bulge 7 in the liquid containers 6 prevents the bottles from tilting toward one another. Consequently, the bundles of bottles of the present invention are extremely stable and can therefore be stacked one atop the other for transport and warehousing. The support ribs 26 reinforce the base cups 8 sufficiently to permit the lowest layer of bottles 4 in such a stack to transmit the weight of the stack to the surface on which the stack rests.

Two interlocked facets will be offset from one another in a vertical direction by a distance equal to the width of at least one horizontal groove and offset from one another in a horizontal direction by a distance equal to the width of at least one vertical groove. Since the horizontal and vertical grooves can be relatively narrow; 1.5 mm, for example; such horizontal and vertical offsets do not ordinarily cause difficulty in stacking bundles of interlocked bottles of the invention.

It is not intended to limit the present invention to the specific embodiment described above. For example, the interlock bands may have more than eight facets. As noted above, the number of facets should be a multiple of 4. The facets may have other than three horizontal grooves and other than three vertical grooves. The facets may have contours or indentation patterns other than grooves to provide for interlocking of facets. The facets may have shapes other than rectangular. Other numbers and arrangements of support ribs can be used. Bundles of bottles of the present invention may be bound together with strips, bands or cords of plastic, metallic or textile material. It is recognized that these and other changes may be made in the invention specifically described herein without departing from the scope and teaching of the instant invention and it is intended to encompass all other embodiments, alternatives, and modifications consistent with the invention.

I claim:

1. In a bottle of the type having:

(a) a liquid container made of a plastic material, the container being generally symmetric in shape about a symmetry axis and having a container opening in it for filling and discharging liquid, the container opening being located so that the symmetry axis passes centrally through the opening;

(b) a top closure for sealing the container opening; and (c) a base cup joined to the liquid container at an end of the container generally opposite to the container opening, the base cup being made of a plastic material and being shaped to permit the bottle to stand upright on a horizontal surface with the symmetry axis of the container extending in a substantially vertical direction, a bottle-rest reference surface being defined to be a plane tangent to the points of the base cup on which the base cup rests when the bottle is standing upright on a horizontal surface;

the improvement which comprises:

(i) a base-cup interlock band joined to the base cup, the interlock band extending generally parallel to the bottle-rest reference plane and around an outer surface of the base cup, the interlock band including a plurality of interlock band segments, each interlock band segment corresponding to a side of a reference equilateral polygon defined to be lying in the reference plane and centered on the symmetry axis, the number of interlock band segments being equal to four times an integer greater than one, an outwardly facing surface of each interlock band segment defining an interlock facet, each interlock facet extending in a direction generally parallel to the corresponding side of the reference polygon and in a direction generally parallel to the symmetry axis, an intersection between each pair of adjacent interlock-band segments being generally rounded, each interlock facet having a plurality of grooves passing through it extending generally parallel to the symmetry axis of the liquid container to define vertical facet grooves, the width of the vertical facet grooves being greater than the spacing between adjacent grooves to permit the vertical facet grooves of two facets on different bottles to mesh, each pair of adjacent facets having a plurality of grooves extending generally parallel to the reference plane to define horizontal facet grooves, the horizontal facet grooves extending between a first vertical facet groove located on a first facet of a pair of adjacent facets and closest to a second facet of the pair and a second vertical groove located on the second facet and closest to the first facet, the width of the horizontal facet grooves being greater than the spacing between adjacent grooves and the spacing between boundaries of the facet and horizontal facet grooves adjacent to the boundaries to permit the horizontal grooves of two facets of the different bottles to mesh, the horizontal and vertical grooves of the interlock facets thereby cooperating to prevent bottles from moving relative to one another in two directions when the bottles are placed in alignment facet-to-facet with facet grooves engaged; and (ii) a bottle-stacking support connected to the base cup and abutting a base portion of the liquid container, the bottle-stacking support being located symmetrically with respect to the symmetry axis of the liquid container and spaced apart from the bottle-rest reference plane, the base cup being shaped to define a closure guide which opens from the bottle-stacking support to the bottle-rest reference plane, the closure guide being shaped to receive the top of a closure of a second bottle whose symmetry axis is generally colinear with the symmetry axis of the bottle having the bottle-stacking support and to guide the closure top to the bottle-stacking support, the bottle-stacking support being adapted to transmit the weight of the bottle having the bottle-stacking support to the top of the closure of the second bottle.

2. The bottle according to claim 1 in which the number of interlock band segments is eight and the reference polygon is an octagon.

3. A bundle of bottles comprising:

(a) a plurality of the bottles of claim 1 located side-by-side in a substantially rectangular array, each pair of adjacent bottles having a pair of facets in interlocking contact; and (b) a binding surrounding the array of bottles laterally to bind the array together.

4. The bundle according to claim 3 in which the binding is a sheath of plastic shrink-wrap film.

* * * * *